US009795172B1

(12) United States Patent
Lee

(10) Patent No.: US 9,795,172 B1
(45) Date of Patent: Oct. 24, 2017

(54) BREAST-SUPPORTIVE GARMENTS

(71) Applicant: Jenny Lee, Los Angeles, CA (US)

(72) Inventor: Jenny Lee, Los Angeles, CA (US)

( * ) Notice: Subject to any disclaimer, the term of this patent is extended or adjusted under 35 U.S.C. 154(b) by 0 days.

(21) Appl. No.: 15/468,625

(22) Filed: Mar. 24, 2017

Related U.S. Application Data

(60) Provisional application No. 62/456,801, filed on Feb. 9, 2017, provisional application No. 62/494,933, filed on Aug. 26, 2016, provisional application No. 62/494,216, filed on Aug. 1, 2016, provisional application No. 62/493,982, filed on Jul. 25, 2016.

(30) Foreign Application Priority Data

Sep. 9, 2016 (KR) ..... 10-2016-0116667

(51) Int. Cl.

| | |
|---|---|
| ***A41C 3/00*** | (2006.01) |
| ***A41C 3/12*** | (2006.01) |
| ***A41C 1/06*** | (2006.01) |
| ***A41C 1/14*** | (2006.01) |
| ***A41C 3/08*** | (2006.01) |

(52) U.S. Cl.
CPC ..... *A41C 3/12* (2013.01); *A41C 1/06* (2013.01); *A41C 1/14* (2013.01); *A41C 3/0057* (2013.01); *A41C 3/08* (2013.01)

(58) Field of Classification Search
CPC .... A41C 3/00; A41C 1/00; A41C 3/12; A41C 3/08; A41C 1/06; A41C 1/14
USPC ..... 450/53–60, 67
See application file for complete search history.

(56) References Cited

U.S. PATENT DOCUMENTS 2,897,822 A * 8/1959 Amyot ..... A41C 3/00 450/59
3,024,789 A * 3/1962 Amyot ..... A41C 3/00 450/59

(Continued)

FOREIGN PATENT DOCUMENTS

JP 2000-096312 A 4/2000
JP 2001-064802 A 3/2001

(Continued)

OTHER PUBLICATIONS

English-language abstract of Japan Patent Application Publication No. 2000-096312, Apr. 4, 2000.

(Continued)

*Primary Examiner* — Gloria Hale
(74) *Attorney, Agent, or Firm* — Dascenzo Intellectual Property Law P.C.

(57) ABSTRACT

Breast-supportive garments comprise a left cup structure, a right cup structure, a first supportive panel, and a second supportive panel. The right cup structure is operatively coupled to the left cup structure. The first supportive panel extends from left of the left cup structure to right of the right cup structure, extending at least partially below the left cup structure and at least partially below the right cup structure. The second supportive panel extends from right of the right cup structure to left of the left cup structure, extending at least partially below the right cup structure and at least partially below the left cup structure. One of the first supportive panel and the second supportive panel extends substantially in front of the other of the first supportive panel and the second supportive panel.

20 Claims, 4 Drawing Sheets

(56) References Cited

U.S. PATENT DOCUMENTS 3,256,886 A * 6/1966 Sachs ..... A41C 3/00
450/59
3,949,760 A * 4/1976 Baranowski ..... A41C 3/00
450/1

FOREIGN PATENT DOCUMENTS

KR 101242469 B1 3/2013
KR 101416436 B1 7/2014

OTHER PUBLICATIONS

English-language machine translation of Japan Patent Application Publication No. 2001-064802, Mar. 13, 2001.
English-language machine translation of Korea Patent No. 101242469, Mar. 15, 2013.
English-language machine translation of Korea Patent No. 101416436, Jul. 10, 2014.

* cited by examiner

BREAST-SUPPORTIVE GARMENTS

RELATED APPLICATIONS

This application claims priority to Korea Patent Application No. 10-2016-0116667, entitled, "A Women's Functional Underwear," which was filed on Sep. 9, 2016, U.S. Provisional Patent Application No. 62/456,801, entitled "Wireless Support Bras and Associated Garments," which was filed on Feb. 9, 2017, U.S. Provisional Patent Application No. 62/494,933, entitled "Wireless Cross Push-Up Bra 3," which was filed on Aug. 26, 2016, U.S. Provisional Patent Application No. 62/494,216, entitled "Cross Strap Push-Up Corset," which was filed on Aug. 1, 2016, and U.S. Provisional Patent Application No. 62/493,982, entitled "Wireless Cross Push-Up Bra 2," which was filed on Jul. 25, 2016. The complete disclosures of the aforementioned applications are incorporated herein by reference.

FIELD

The present disclosure relates to breast-supportive garments.

BACKGROUND

Breast-supportive garments may date as far back as ancient Greece. In the $16^{th}$ century AD, corsets for pushing breasts upward to enhance cleavage came into fashion. The first mass-produced modern bras arrived in the late $19^{th}$ century to early $20^{th}$ century. Today, more than half of bras sold in the United States include underwires to give the wearer's breasts a desired shape, as well as to support the breasts from underneath. Many modern bras also incorporate push-up pads within the lower portion of the bra's cups to lift the wearer's breasts and thereby enhance cleavage. The WONDERBRA™ brand of bras dating back to the 1940s and the MIRACLE BRA™ brand that was made popular in the 1990s by VICTORIA'S SECRET™ are examples of such cleavage enhancing bras with underwires and push-up pads. However, both underwires and push-up pads often are, or become over the course of the day, uncomfortable to the wearer.

Modern bra manufacturers typically offer 36 or more sizes based on a band size and a cup size, where the band size typically corresponds to a length around a wearer's torso just below the breasts, and where the cup size corresponds to the volume of a breast, yet a cup size designation corresponds to different volumes for different band sizes (e.g., an A-cup for a 32 inch band size is the same size as a B-cup for a 30 inch band size). However, sizes can vary considerably by manufacturer, and retailers use various methods for measuring bra size for a wearer. Moreover, breasts vary significantly in size, shape, spacing, firmness, etc. Accordingly, it is very difficult for shoppers to be properly fitted and arrive at a proper bra size. When bras include underwires, which come in preset radii of curvature, it is even more difficult to arrive at a proper size and fit of bra. Ultimately, many women do not wear properly sized bras, resulting in discomfort and even medical issues (e.g., back problems) for women.

SUMMARY

Breast-supportive garments, associated articles of clothing, and methods of donning breast-supportive garments and articles of clothing are disclosed.

Breast-supportive garments according to the present disclosure comprise a left cup structure, a right cup structure, a first supportive panel, and a second supportive panel. The right cup structure is operatively coupled to the left cup structure. The first supportive panel extends from left of the left cup structure to right of the right cup structure, extending at least partially below the left cup structure and at least partially below the right cup structure. The second supportive panel extends from right of the right cup structure to left of the left cup structure, extending at least partially below the right cup structure and at least partially below the left cup structure. One of the first supportive panel and the second supportive panel extends substantially in front of the other of the first supportive panel and the second supportive panel.

Articles of clothing according to the present disclosure comprise a breast-supportive garment according to the present disclosure integrated into the article of clothing.

Methods of donning breast-supportive garments or articles of clothing according to the present disclosure comprise positioning the left cup structure against a wearer's left breast and positioning the right cup structure against a wearer's right breast.

DESCRIPTION

Figure 1:
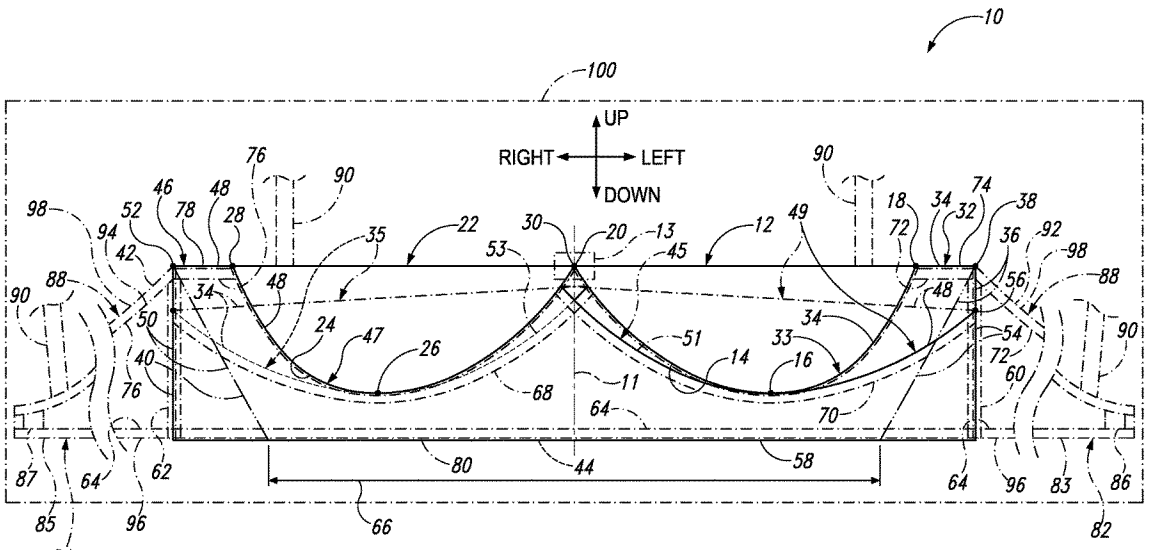
FIG. 1 is a schematic front representation of breast-supportive garments according to the present disclosure.

Breast-supportive garments 10 and associated articles of clothing 100 according to the present disclosure are schematically represented in FIG. 1. Generally, in FIG. 1, elements that are likely to be included in a given example are illustrated in solid lines, while elements that are optional to a given example are illustrated in dash-dot lines. However, elements that are illustrated in solid lines are not essential to all examples of the present disclosure, and an element shown in solid lines may be omitted from a particular example without departing from the scope of the present disclosure.

As represented in FIG. 1 and as described herein, the various elements of breast-supportive garments 10 may be described in terms of relative positions to each other when the breast-supportive garment 10 is donned by a wearer when the wearer is standing vertically and from the perspective of the wearer. Accordingly, when describing a first element as being left or right of a second element, the first element is further away along the lateral span of the breast-supportive garment 10 in the respective direction from a midline 11 that generally bisects the breast-supportive garment; however, the first element is not necessarily directly to the left or right of the second element along a horizontal vector. Moreover, when a breast-supportive garment 10 is donned by a wearer, a first element that is left or right of a second element may wrap around the wearer's body such that, in three-dimensional space, the first element is not necessarily to the left or right of the second element from the perspective of the wearer; however, the first element is still considered to be left or right of the second element, as used herein. Similarly, the terms above, below, upper, lower, front, behind, and similar terms relate to a breast-supportive garment 10 when donned by a wearer standing vertically and from the perspective of the wearer. Accordingly, when describing a first element as being above or below a second element, the first element falls in a horizontal plane that is above or below a horizontal plane in which the second element falls, but the first element is not necessarily directly above or below the second element along a vertical vector. Breast-supportive garments 10 additionally or alternatively may be described in terms of relative directions associated with a wearer's body when a breast-supportive garment 10 is donned, such as in terms of being superior (upward), medial (inward), lateral (left or right), inferior (below), posterior (rearward), and anterior (forward).

Additionally, an "edge" of an element of breast-supportive garments 10, as used herein, additionally or alternatively may be referred to as, or described as, an edge region, a margin, or a boundary of the element, and an "edge" is not necessarily the absolute two-dimensional terminus of the element. For example, as typical in garment construction, seams may have a width to them and the region associated with a seam may be considered the edge of the element. Moreover, two panels of material being secured together at a seam often are not perfectly aligned along their terminuses. Moreover, a seam within an expanse of material may define an "edge" of a sub-portion of that expanse of material, with the sub-portion optionally being described as a "panel" of the material. In other words, two adjacent panels may in fact be constructed of the same piece of material with a seam or other structure defining an edge, or boundary, between the two adjacent panels.

As schematically represented in FIG. 1, breast-supportive garments 10 comprise at least a left cup structure 12, a right cup structure 22, a first supportive panel 32, and a second supportive panel 46.

The right cup structure 22 is operatively coupled to the left cup structure 12. In some examples, the right cup structure 22 may be directly coupled, or secured, to the left cup structure 12. In other examples, the breast-supportive garment 10 may comprise a cup coupling structure 13 that extends between and couples the two cup structures together, as schematically and optionally represented in FIG. 1. Herein, when describing elements of breast-supportive garments 10 as being secured or directly coupled to each other, it should be understood that any suitable mechanism for securing elements together, such as are typically and commonly used in the construction of garments, may be used, including (but not limited to) stitching, gluing, and welding, for example, depending on the material of construction.

The cup structures of breast-supportive garments 10 may take a variety of forms, including traditional cups that have a concave inner (or medial) surface and a convex outer (or anterior) surface. Typically, although not required, the left cup structure 12 has a lower edge 14 that is arcuate, or curved, and the right cup structure 22 has a lower edge 24 that is arcuate, or curved, such as generally corresponding to the lower contours of breasts. In some breast-supportive garments 10, the cup structures may be sized to extend across a substantial portion of a wearer's breasts and may be described as full cups. In other breast-supportive garments 10, the cup structures may be sized to extend across about half to about three-quarters of a wearer's breasts and may be described as demi-cups. Other sizes, shapes, and constructions of cup structures 12, 22 also may be used and incorporated into breast-supportive garments 10.

In some examples of breast-supportive garments 10, the left cup structure 12 is sized so that the lower edge 14 thereof is positioned in front of a wearer's left breast and above a lower extent of the wearer's left breast when the breast-supportive garment is properly donned, and the right cup structure 22 is sized so that the lower edge 24 thereof is positioned in front of the wearer's right breast and above a lower extent of the wearer's right breast when the breast-supportive garment 10 is properly donned. That is, such breast-supportive garments 10 are constructed and sized so that the lower edges of the cup structures are not positioned beneath a wearer's breast, as is the case with underwire bras. Rather, the cup structures of such breast-supportive garments 10, and in particular the lower edges of the cup structures, together with the first supportive panel 32 and the second supportive panel 46, facilitate the pushing upward of a wearer's breasts, which may result in enhanced cleavage when the breast-supportive garment 10 is sized properly and donned by the wearer. Moreover, because the cup structures of such breast-supportive garments 10 are not sized such that their lower edges are intended to extend below the lower extent of the wearer's breasts against the wearer's torso, the sizing of breast-supportive garments 10 is much easier than traditional bras, for example. That is, a selection of cup size is not critical to the proper sizing, fit, and ultimate comfort level of a breast-supportive garment 10.

Some breast-supportive garments 10 are free of (i.e., do not include) rigid underwires that are positioned at, or otherwise associated with, the lower edges of the cup structures. That said, cup structures of breast-supportive garments 10 may incorporate various suitable structures or features that define, or otherwise provide some stiffness or rigidity, to the lower edges of the cup structures. For example, the lower edges of the cup structures may include a bound seam, such as that includes a binding strip and/or piping. Other structures also may be associated with the lower edges of the cup structures of breast-supportive garments 10. The absence of rigid underwires, together with the intended placement of the cup structures above the lower extent of a wearer's breasts, as discussed above, further makes selection of cup size and sizing of breast-supportive garments 10 easier than fitting traditional bras.

Additionally or alternatively, while not including traditional underwires that extend a full, or substantially full, span of the lower edges of the cup structures, some breast-supportive garments 10 may include rigid structures, including wire or wire-like structures, that span only a portion of the lower edges of the cup structures. For example, in breast-supportive garments 10 that do not include shoulder straps (e.g., in the form of strapless bras or strapless swim tops), it may be advantageous to incorporate a rigid structure or structures along the lower edges of the cup structures proximal to the midline 11 of the breast-supportive garment, such as to restrict the central (or medial) portions of the cup structures from sagging. In some such examples, a single rigid structure, such as a rigid wire or wire-like structure generally in the shape of an upside-down V or U may be operatively secured along the lower edges of the cup structures proximal the midline 11.

In some breast-supportive garments 10, the left cup structure 12 and the right cup structure 22 are free of (i.e., do not include) push-up pads, such that are traditionally used in cleavage enhancing undergarments. Additionally or alternatively, the cup structures in some breast-supportive garments 10 may be generally uniform in thickness across their entireties or substantially across their entireties other than perhaps at the lower edges thereof, such as when bound or other type of seams are used.

With continued reference to FIG. 1, the first supportive panel 32 extends from left of (or lateral to) the left cup structure 12 to right of (or lateral to) the right cup structure 22. Moreover, the first supportive panel 32 extends at least partially below (or inferior to) the left cup structure 12 and at least partially below (or inferior to) the right cup structure 22. In some examples of breast-supportive garments 10, at least when properly donned by a wearer, the first supportive panel 32 extends completely below the cup structures other than perhaps a small overlap associated with a lower edge seam of one or both of the cup structures. In other examples, the first supportive panel 32 extends at least partially behind (or posterior to) and overlaps a portion of the lower edge 24 and a lower portion of the right cup structure 22.

Similarly, the second supportive panel 46 extends from right of (or lateral to) the right cup structure 22 to left of (or lateral to) the left cup structure 12, Moreover, the second supportive panel 46 extends at least partially below (or inferior to) the right cup structure 22 and at least partially below (or inferior to) the left cup structure 12. In some examples of breast-supportive garments 10, at least when properly donned by a wearer, the second supportive panel 46 extends completely below the cup structures other than perhaps a small overlap associated with a lower edge seam of one or both of the cup structures. In other examples, the second supportive panel 46 extends at least partially behind (or posterior to) and overlaps a portion of the lower edge 14 and a lower portion of the left cup structure 12.

The first and second supportive panels 32, 46 (optionally together with an optional front panel 80 discussed further below) may be described collectively as defining or forming a combination of one or more of a gore, a bridge, a cradle, a front band, or a front frame of a breast-supportive garment 10.

In addition, one of the first supportive panel 32 and the second supportive panel 46 extends substantially in front of (or anterior to) the other of the first supportive panel 32 and the second supportive panel 46. In the schematic representation of FIG. 1, the second supportive panel 46 extends in front of (or anterior to) the first supportive panel 32, as indicated by the hidden (dashed) line associated with a right-side span 35 of an upper edge 34 of the first supportive panel 32 (i.e., a span of the upper edge 34 that is substantially right of the midline 11). However, breast-supportive garments 10 alternatively may be constructed with the first supportive panel 32 extending in front of (or anterior to) the second supportive panel 46.

Because the supportive panels extend from laterally beyond the cup structures and extend at least partially below and in some examples across the cup structures, when a breast-supportive garment 10 is sized properly and donned by a wearer, the supportive panels collectively bring together and push upward a wearer's breasts within the cup structures and thereby may enhance the wearer's cleavage. More specifically, in some examples of breast-supportive garments 10, the right-side span 35 of the upper edge 34 of the first supportive panel 32 presses against the outer surface of the wearer's right breast and effectively pushes the right breast upward, and a left-side span 49 of an upper edge 48 of the second supportive panel 46 (i.e., a span of the upper edge 48 that is substantially left of the midline 11) presses against the outer surface of the wearer's left breast and effectively pushes the left breast upward, at least when the breast-supportive garment 10 is sized properly and donned by the wearer. Breast-supportive garments 10 additionally or alternatively may be described as cleavage enhancing garments or bust enhancing garments.

With continued reference to FIG. 1, in some examples of breast-supportive garments 10, a left-side span 33 of the upper edge 34 of the first supportive panel 32 (i.e., a span of the upper edge 34 that is substantially left of the midline 11 is secured to a substantial length of the lower edge 14 of the left cup structure 12. Similarly, in some examples of breast-supportive garments 10, the right-side span 47 of the upper edge 48 of the second supportive panel 46 (i.e., a span of the upper edge 48 that is substantially right of the midline 11) is secured to a substantial length of the lower edge 24 of the right cup structure 22.

In contrast, in some examples of breast-supportive garments 10, the right-side span 35 of the upper edge 34 of the first supportive panel 32 is not secured to the lower edge 24 of the right cup structure 22 and is not secured to the second supportive panel 46. Similarly, in some examples of breast-supportive garments 10, the left-side span 49 of the upper edge 48 of the second supportive panel 46 is not secured to the lower edge 14 of the left cup structure 12 and is not secured to the first supportive panel 32. Accordingly, in such examples, the right-side span 35 of the upper edge 34 of the first supportive panel 32 and the left-side span 49 of the upper edge 48 of the second supportive panel 46 may be described as free-floating. Additionally or alternatively, the first and second supportive panels may be described as defining a pocket 45 between the two supportive panels with a left-side top opening 51 between the left-side span 49 of the upper edge 48 of the second supportive panel 46 and the first supportive panel 32, and with a right-side top opening 53 between the right-side span 35 of the upper edge 34 of the first supportive panel 32 and the second supportive panel 46.

As schematically represented in FIG. 1, in some examples of breast-supportive garments 10, an upper-most point 38 of a left edge 36 of the first supportive panel 32 is positioned left (or lateral) of a left-most point 18 of the left cup structure 12. Similarly, in some examples of breast-supportive garments 10, an upper-most point 52 of a right edge 50 of the second supportive panel 46 is positioned right (or lateral) of a right-most point 28 of the right cup structure 22. In some such examples, a left-side span 74 of the upper edge 34 of the first supportive panel 32 (i.e., between the left-most point 18 of the left cup structure 12 and the upper-most point 38 of the left edge 36 of the first supportive panel 32) and a right-side span 78 of the upper edge 48 of the second supportive panel 46 (i.e., between the right-most point 28 of the right cup structure 22 and the upper-most point 52 of the right edge 50 of the second supportive panel 46) each may be at least 3%, at least 5%, at least 7%, at least 9%, greater than 9%, or 3-10% of a horizontal width of one of the cup structures 12, 22 (i.e., a horizontal distance between the left-most point 18 and a right-most point 20 of the left cup structure 12 and a horizontal distance between the right-most point 28 and a left-most point 30 of the right cup structure 22, at least when the cup structures are in a relaxed, non-deformed state).

In some examples of breast-supportive garments 10, an upper-most point 42 of a right edge 40 of the first supportive panel 32 is positioned above (or superior to) a lower-most point 26 of the right cup structure 22. Similarly, in some examples of breast-supportive garments 10, an upper-most point 56 of a left edge 54 of the second supportive panel 46 is positioned above (or superior to) a lower-most point 16 of the left cup structure 12. In some such examples, the upper-most point 42 and the upper-most point 56 may be positioned vertically above (or superior to) the lower-most point 26 and the lower-most point 16 by a distance that is at least 3%, at least 5%, at least 10%, or greater than 10% of a vertical distance between the lower-most point 26 and the right-most point 28 and between the lower-most point 16 and the left-most point 18, at least when the breast-supportive garment 10 is sized properly and donned by a wearer. As a result, when such breast-supportive garments 10 are properly donned by a wearer, the first and second supportive panels facilitate the bringing together of the wearer's breasts.

With continued reference to FIG. 1, in some examples of breast-supportive garments 10, the right-side span 35 of the upper edge 34 of the first supportive panel 32 extending from the lower edge 14 of the left cup structure 12 to the upper-most point 42 of the right edge 40 of the first supportive panel 32 is concave. Similarly, in some examples of breast-supportive garments 10, the left-side span 49 of the upper edge 48 of the second supportive panel 46 extending from the lower edge 24 of the right cup structure 22 to the upper-most point 56 of the left edge 54 of the second supportive panel 46 is concave. In some such examples, the right-side span 35 of the upper edge 34 of the first supportive panel 32 and the left-side span 49 of the upper edge 48 of the second supportive panel 46 may generally coincide with or otherwise extend along at least a portion of the lower edge 24 of the right cup structure 22 and the lower edge 14 of the left cup structure 12, respectively. Accordingly, the concave shapes of the right-side span 35 of the upper edge 34 and the left-side span 49 of the upper edge 48, when extending across the lower extents of a wearer's breasts, supports the breasts from beneath (or inferior) the breasts and functions to lift them.

However, other configurations of the right-side span 35 of the upper edge 34 of the first supportive panel 32 and the left-side span 49 of the upper edge 48 of the second supportive panel 46 also may be incorporated into breast-supportive garments 10, including for example, a right-side span 35 of the upper edge 34 of the first supportive panel 32 and a left-side span 49 of the upper edge 48 of the second supportive panel 46 that are generally straight, as schematically and optionally represented in dash-dot lines in FIG. 1, as well as examples that are shaped between the optional straight representations of FIG. 1 and the concave representations of FIG. 1.

With continued reference to FIG. 1, in some examples of breast-supportive garments 10, the left edge 36 of the first supportive panel 32 coincides with and is secured to the left edge 54 of the second supportive panel 46, such as corresponding to a seam at which the first supportive panel 32 and the second supportive panel 46 are secured together. However, this does not mean that one or both of the supportive panels cannot be constructed of a length of material that extends beyond the left edge of the respective supportive panel. Moreover, by "coincides with," it is not meant that the left edges of the supportive panels are the same length. For example, as schematically represented in FIG. 1, the upper-most point 38 of the left edge 36 of the first supportive panel 32 may be above the upper-most point 56 of the left edge 54 of the second supportive panel 46.

Similarly, in some examples of breast-supportive garments 10, the right edge 40 of the first supportive panel 32 coincides with and is secured to the right edge 50 of the second supportive panel 46, such as corresponding to a seam at which the first supportive panel 32 and the second supportive panel 46 are secured together. Again however, this does not mean that one or both of the supportive panels cannot be constructed of a length of material that extends beyond the right edge of the respective supportive panel. Moreover, by "coincides with," it is not meant that the right edges of the supportive panels are the same length. For example, as schematically represented in FIG. 1, the upper-most point 52 of the right edge 50 of the second supportive panel 46 may be above the upper-most point 42 of the right edge 40 of the first supportive panel 32.

In some examples of breast-supportive garments 10, a lower edge 44 of the first supportive panel 32 coincides (optionally coextensively) with and is secured to a lower edge 58 of the second supportive panel 46, such as corresponding to a seam at which the first supportive panel 32 and the second supportive panel 46 are secured together. Again however, this does not mean that one or both of the supportive panels cannot be constructed of a length of material that extends beyond the lower edge of the respective supportive panel.

As schematically represented in FIG. 1, some breast-supportive garments 10 further comprise a left boning structure 60 and a right boning structure 62. When present, the left boning structure 60 is operatively coupled to one or both of the first supportive panel 32 and the second supportive panel 46, generally coinciding with one or both of the left edge 36 of the first supportive panel 32 and the left edge 54 of the second supportive panel 46. In some examples, the left boning structure 60 is generally coextensive with the left edge 36 of the first supportive panel 32. Similarly, when present, the right boning structure 62 is operatively coupled to one or both of the first supportive panel 32 and the second supportive panel 46 and generally coinciding with one or both of the right edge 50 of the second supportive panel 46 and the right edge 40 of the first supportive panel. In some examples, the right boning structure 62 is generally coextensive with the right edge 50 of the second supportive panel 46. The boning structures, when present, may take any suitable form including (but not limited to) traditional garment boning, including metal wire boning and plastic boning, such as featherlite boning, flexicure boning, and ridgeline boning. Additionally or alternatively, the optional boning structures of breast-supportive garments 10 simply may be constructed of multiple layers of material and/or of a rolled up edge of material secured together at the left and right edges of the supportive panels to define thickened, semi-rigid structures.

When present, the left boning structure 60 and the right boning structure 62 serve to anchor the left edges and the right edges of the supportive panels against the side of the torso of the wearer to the left and right (or lateral) of the wearer's breasts, respectively. Accordingly, when sized properly and donned by a wearer, the supportive panels pull on the boning structures toward the midline 11 of the breast-supportive garment 10 at the front of the wearer, and the portion of the breast-supportive garment 10 or associated article of clothing 100 that extends around the back of the wearer, as discussed below, pull on the boning structure in the opposite direction. As a result of the anchoring of the left and right edges of the supportive panels by the boning structures, the supportive panels collectively bring together and push upward a wearer's breasts to enhance the wearer's cleavage.

With continued reference to FIG. 1, some breast-supportive garments 10 further comprise a lower-edge elastic band 64 that extends along the lower edge 44 of the first supportive panel 32 and the lower edge 58 of the second supportive panel 46. When present, as schematically indicated in FIG. 1, the lower-edge elastic band 64 has a relaxed length 66 when a tensile force is not applied to the lower-edge elastic band 64, such as when the breast-supportive garment 10 is not donned by a wearer, with the relaxed length 66 being less than a distance between the upper-most point 38 of the left edge 36 of the first supportive panel 32 and the upper-most point 52 of the right edge 50 of the second supportive panel 46 when the breast-supportive garment 10 is donned by a wearer. As schematically illustrated in FIG. 1 in dash-dot-dot lines, the left edges 36, 54 and the right edges 40, 50 of the supportive panels may be angled relative to the midline 11, at least when no tensile force is applied to the lower-edge elastic band 64, such as when the breast-supportive garment 10 is not donned. However, when such a breast-supportive garment 10 is sized properly and donned by a wearer, a tensile force is applied to the lower-edge elastic band 64, and the lower-edge elastic band facilitates the supportive function of the breast-supportive garment 10. In some examples of breast-supportive garments 10, the relaxed length 66 of the lower-edge elastic band 64 is less than a distance between the left-most point 18 of the left cup structure 12 and the right-most point 28 of the right cup structure 22 when the breast-supportive garment 10 is donned by a wearer.

Some breast-supportive garments 10 further comprise a first-supportive-panel right-side upper-edge elastic band 68 that extends along the right-side span 35 of the upper edge 34 of the first supportive panel 32, and a second-supportive-panel left-side upper-edge elastic band 70 that extends along the left-side span 49 of the upper edge 48 of the second supportive panel 46. Accordingly, when such breast-supportive garments 10 are sized properly and donned by a wearer, the upper-edge elastic bands 68, 70 facilitate the function of the supportive panels to bring together and support from beneath the wearer's breasts. Moreover, in breast-supportive garments 10 that further comprise boning structures 60, 62, the upper-edge elastic bands 68, 70 are secured to, or adjacent to, the boning structures, which may further facilitate the cleavage enhancing and breast supporting functions of the breast-supportive garments 10.

In addition and with continued reference to FIG. 1, some breast-supportive garments 10 further comprise a first-supportive-panel left-side upper-edge elastic band 72 that extends along the left-side span 74 of the upper edge 34 of the first supportive panel 32 between the left-most point 18 of the left cup structure 12 and the upper-most point 38 of the left edge 36 of the first supportive panel 32. Similarly, such breast-supportive garments 10 further comprise a second-supportive-panel right-side upper-edge elastic band 76 that extends along the right-side span 78 of the upper edge 48 of the second supportive panel 46 between the right-most point 28 of the right cup structure 22 and the upper-most point 52 of the right edge 50 of the second supportive panel 46. Moreover, in breast-supportive garments 10 that further comprise boning structures 60, 62, the upper-edge elastic bands 72, 76 are secured to, or adjacent to, the boning structures, which may further facilitate the cleavage enhancing and breast supporting functions of the breast-supportive garments 10.

In addition to or as an alternative to comprising elastic bands at the identified edges of the first and second supportive panels, in some breast-supportive garments 10, the first supportive panel 32 and the second supportive panel 46 are constructed of an elastic, or other resilient or stretchable, material themselves, which may facilitate the cleavage enhancing and breast supporting functions of such breast-supportive garments 10. For example, in such breast-supportive garments 10, the lower edge 44 of the first supportive panel 32 and the lower edge 58 of the second supportive panel 46 have a relaxed length 66 when a lateral tensile force is not applied to the first supportive panel 32 and the second supportive panel 46, such as when the breast-supportive garment 10 is not donned by a wearer, with the relaxed length 66 being less than a distance between the upper-most point 38 of the left edge 36 of the first supportive panel 32 and the upper-most point 52 of the right edge 50 of the second supportive panel 46 when the breast-supportive garment 10 is donned by a wearer. In some such examples, the relaxed length 66 also is less than a distance between the left-most point 18 of the left cup structure 12 and the right-most point 28 of the right cup structure 22, as measured when the breast-supportive garment 10 is sized properly and donned. By being constructed of an elastic material, the first and second supportive panels function to bring together and support from beneath a wearer's breasts, when such breast-supportive garments 10 are sized properly and donned.

With continued reference to FIG. 1, some breast-supportive garments 10 further comprise a front panel 80 that extends in front of (or anterior to) and that covers the first supportive panel 32 and the second supportive panel 46. In some such examples, the front panel 80 is secured along the lower edge 14 of the left cup structure 12, along the lower edge 24 of the right cup structure 22, along the lower edge 44 of the first supportive panel 32, along the lower edge 58 of the second supportive panel 46, along the left edge 36 of the first supportive panel 32, along the left edge 54 of the second supportive panel 46, along the right edge 40 of the first supportive panel 32, and along the right edge 50 of the second supportive panel 46. In some examples, the front panel 80 may be aesthetic in nature, in so far as it hides from view the right-side span 35 of the upper edge 34 of the first supportive panel 32 and the left-side span 49 of the upper edge 48 of the second supportive panel 46 and creates a uniform expanse of material across the front (or anterior) of the breast-supportive garment 10 and below (or inferior to) the cup structures. Additionally or alternatively, the optional front panel 80, when present, may further enhance the function of breast-supportive garments 10, such as if constructed of an elastic, or other resilient or stretchable, material and sized to aid in the bringing together and supporting from beneath a wearer's breasts when donned. Additionally or alternatively, the front panel 80 may be constructed from a material that is different from a material of one or both of the first supportive panel 32 and the second supportive panel 46.

As schematically illustrated in FIG. 1, some breast-supportive garments 10 further comprise a left panel 82 that extends left of the supportive panels 32, 46, that is, left of the left edges 36, 54 thereof, and a right panel 84 that extends right of the supportive panels 32, 46, that is, right of the right edges 40, 50 thereof. Such breast-supportive garments 10 additionally may comprise a left fastening mechanism 86 that is coupled to the left panel 82, and a right fastening mechanism 87 that is coupled to the right panel 84 and that is configured to be selectively coupled to the left fastening mechanism 86 behind a wearer's back when the breast-supportive garment 10 is donned. Any suitable fastening mechanisms may be used, including (but not limited to) traditional bra clasps and hooks, hook-and-loop fasteners (e.g., VELCRO™ fasteners), magnetic fasteners, etc. Breast-supportive garments 10 having left and right panels 82, 84 and corresponding fastening mechanism 86, 87 may be configured as, constructed as, or otherwise described as bras, bra tops, bikini tops, or swimwear tops. Left and right panels 82, 84 additionally or alternatively may be referred to as left and right wings or left and right bands.

In some such examples of breast-supportive garments 10 that also comprise a lower-edge elastic band 64, the lower-edge elastic band 64 may further extend along a lower edge 83 of the left panel 82 and along a lower edge 85 of the right panel 84. Similarly, in examples that also comprise upper-edge elastic bands 72, 76, the upper-edge elastic band 72 may further extend along an upper edge 92 of the left panel 82, and the upper-edge elastic band 76 may further extend along an upper edge 94 of the right panel 84. Accordingly, when such a breast-supportive garment 10 is sized properly and donned by a wearer, the lower-edge elastic band 64 may extend fully or substantially around the wearer's torso, and the upper-edge elastic bands 72, 76 may extend from the left and right cup structures, respectively, around the wearer's back. Moreover, in examples that also comprise boning structures 60, 62, having the elastic bands extend across the boning structures, or at least on opposing sides of the boning structures, facilitates the anchoring of the boning structures at the lateral sides of the wearer, with the elastic bands imparting opposing forces across the boning structures when the breast-supportive garment is sized properly and donned by a wearer.

In addition to or as an alternative to comprising elastic bands 64, 72, 76, the left and right panels 82, 84 may be constructed of an elastic, or other resilient or stretchable, material and serve a similar or identical function as the elastic bands.

In some examples of breast-supportive garments 10 that include left and right panels 82, 84, the left and right panels may be constructed of distinct pieces of material from the first and second supportive panels 32, 46, such that they are operatively secured to the respective left and right edges of the supportive panels at seams. Alternatively, the left panel 82 may be constructed of the same piece of material as the first supportive panel 32 with a seam defining the left edge 36 thereof, such as where the second supportive panel 46 is secured to the first supportive panel 32 and optionally with left boning structure 60, as well. Similarly, the right panel 84 may be constructed of the same piece of material as the second supportive panel 46 with a seam defining the right edge 50 thereof, such as where the first supportive panel 32 is secured to the second supportive panel 46 and optionally with right boning structure 62, as well.

Alternatively, and as also schematically represented in FIG. 1, some breast-supportive garments 10 comprise a back panel 88 that extends left of and right of the supportive panels 32, 46 to create a closed loop with the supportive panels 32, 46 for selective receipt of a wearer's upper torso when the breast-supportive garment 10 is donned. Such breast-supportive garments 10 therefore may be free of (i.e., do not include) fastening mechanisms, and may be described as pull-over tops, such that they are constructed to be donned by being pulled over a wearer's head and onto the wearer's upper torso.

In some such examples of breast-supportive garments 10 that also have a lower-edge elastic band 64, the lower-edge elastic band 64 further extends along a lower edge 96 of the back panel 88. Similarly, in examples that also comprise upper-edge elastic bands 72, 76, the upper-edge elastic band 72 and the upper-edge elastic band 76 may be the same elastic band that further extends along an upper edge 98 of the back panel 88.

In addition to or as an alternative to comprising elastic bands 64, 72, 76, the back panel 88 may be constructed of an elastic, or other resilient or stretchable, material and serve a similar or identical function as the elastic bands.

Moreover, in some examples of breast-supportive garments 10 that include a back panel 88, the back panel may be constructed of a distinct piece of material from the first and second supportive panels 32, 46, such that the back panel 88 is operatively secured to the respective left and right edges of the supportive panels at seams. Alternatively, the back panel 88 may be constructed of the same piece of material as one or both of the first supportive panel 32 and the second supportive panel 46. For example, if all three panels are constructed from the same piece of material, the piece of material may initiate at the right edge 40 of the first supportive panel 32, extending across the front (or anterior) of the breast-supportive garment 10 as the first supportive panel 32, past the left edge 36 of the first supportive panel 32, and extending around the rear (or posterior) of the breast-supportive garment 10 as the back panel 88, where it is secured to the right edge 50 of the second supportive panel 46 (e.g., at a seam and optionally with right boning structure 62), further extending across the front (or anterior) of the breast-supportive garment 10 as the second supportive panel 46, terminating at the left edge 54 of the second supportive panel 46, where it is secured to the left edge 36 of the first supportive panel 32 (e.g., at a seam and optionally with left boning structure 60).

With continued reference to FIG. 1, some breast-supportive garments 10 further comprise shoulder straps 90 that are operatively coupled relative to the left cup structure 12 and the right cup structure 22 and that are configured to extend over a wearer's shoulders when the breast-supportive garment 10 is donned. Any suitable construction of shoulder straps 90 may be utilized including adjustable shoulder straps, non-adjustable shoulder straps, shoulder straps that do not cross in the rear of the breast-supportive garment when donned, shoulder straps that do cross, or otherwise come together, in the rear of the breast-supportive garment 10 when donned, etc.

In some such examples of breast-supportive garments 10 that also comprise left and right panels 82, 84, the shoulder straps 90 are operatively coupled to the left and right panels 82, 84. In other such examples of breast-supportive garments 10 that also comprise a back panel 88, the shoulder straps 90 are operatively coupled to the back panel 88.

Breast-supportive garments 10 and various subcomponents, or elements, thereof may be constructed of various suitable materials, such as depending on the ultimate application of a breasts-supportive garment. Illustrative, non-exclusive examples of materials include cotton, silk, satin, spandex, latex, microfiber, lace, polyester, nylon, polybutylene terephthalate (PBT), polyester PBT, polyester spandex blend, cotton-poly-spandex knit, tricot knit, raschel knit, jersey knit, silk and spandex blend, mesh, foam, etc., and any suitable combination thereof.

As schematically represented in FIG. 1, also within the scope of the present disclosure are articles of clothing 100 that comprise a breast-supportive garment 10, or at least the relevant structures thereof, integrated into the article of clothing 100. That is, an article of clothing 100 may comprise more elements than the elements, including optional elements, of breast-supportive garments 10 discussed in detail above. As illustrative, non-exclusive examples, an article of clothing 100 may be a bra, a bra top, a corset, swimwear, a swim top, a single-piece swim top, a one-piece swimsuit, a top, a crop top, a blouse, a shirt, a camisole, a sports bra, a sports top, an athletic top, or a dress. Moreover, such articles of clothing may comprise such elements as sleeves, front panels, rear panels, side panels, a bodice, a skirt, a peplum, and/or various other traditional or non-traditional garment elements. In addition, in some such articles of clothing 100, elements of the breast-supportive garment 10 may be generally hidden from view when an article of clothing 100 is donned by a wearer.

Figure 2:
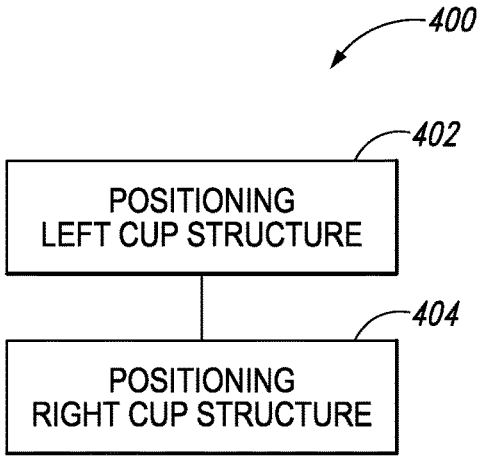
FIG. 2 is a flow chart schematically representing methods of donning breast-supportive garments according to the present disclosure.

FIG. 2 schematically provides a flowchart that represents an illustrative, non-exclusive example of a method 400 of donning breast-supportive garments 10 and articles of clothing 100. The method and steps illustrated in FIG. 2 are not limiting and other methods and steps are within the scope of the present disclosure, including methods having greater than or fewer than the number of steps illustrated, as understood from the discussions herein.

As schematically indicated in FIG. 2, methods 400 of donning a breast-supportive garment 10 or an article of clothing 100 comprise positioning 402 the left cup structure 12 against a wearer's left breast, and positioning 404 the right cup structure 22 against a wearer's right breast. In some such methods 400, the positioning 402 comprises positioning the lower edge 14 of the left cup structure 12 in front of and above the lower extent of the wearer's left breast, and the positioning 404 comprises positioning the lower edge 24 of the right cup structure 22 in front of and above the lower extent of the wearer's right breast. Accordingly, when sized properly and donned, the supportive panels 32, 46, together with the operative positioning of the cup structures 12, 22 function to bring together and support from beneath the wearer's breasts.

Depending on the configuration of a breast-supportive garment 10 or an article of clothing 100 and optional elements thereof, methods 400 may further comprise one or more of such additional steps as positioning the left and right boning structures 60, 62 in operative positions on the lateral sides of the wearer's upper torso, positioning the shoulder straps 90 over the wearer's shoulders, and fastening the left and right fastening mechanisms 86, 87.

Figure 4:
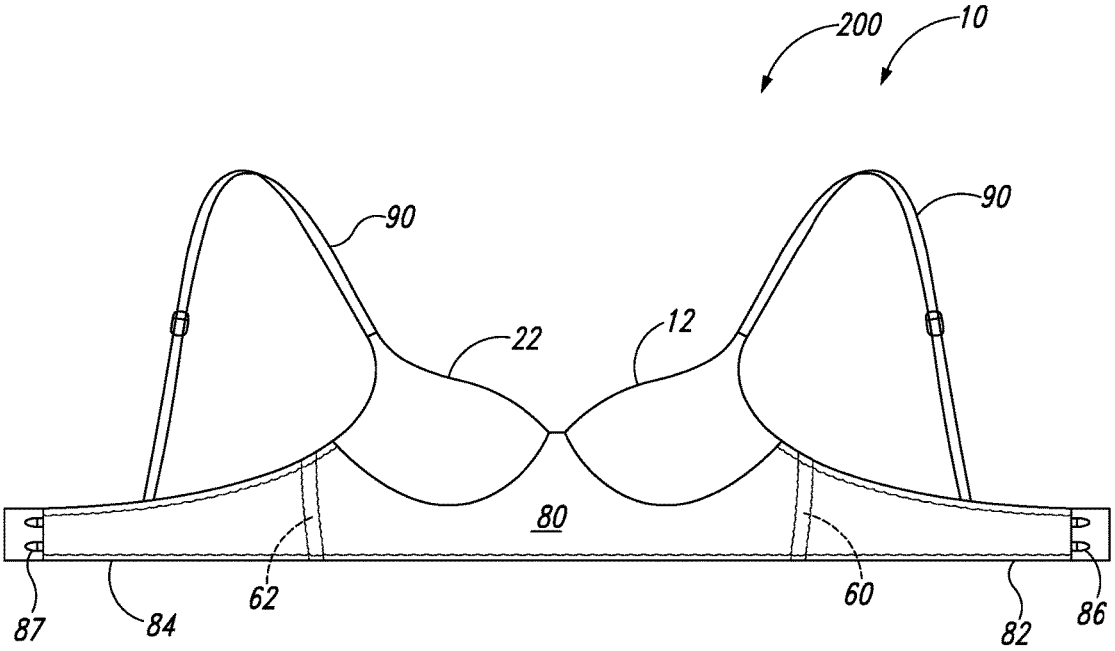
FIG. 4 is a front and open view of the bra of FIG. 3.
Figure 5:
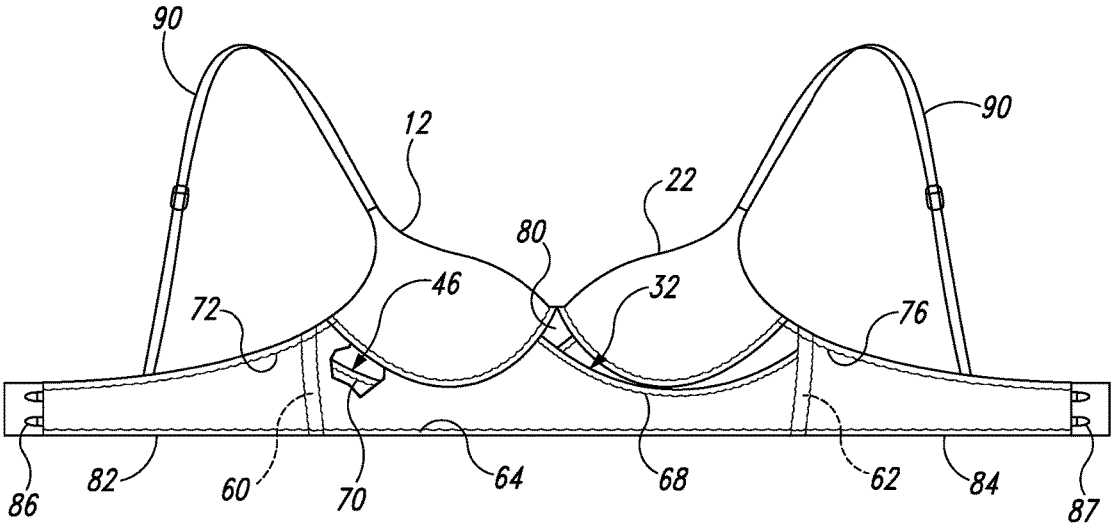
FIG. 5 is a partial fragmentary rear and open view of the bra of FIG. 3.
Figure 6:
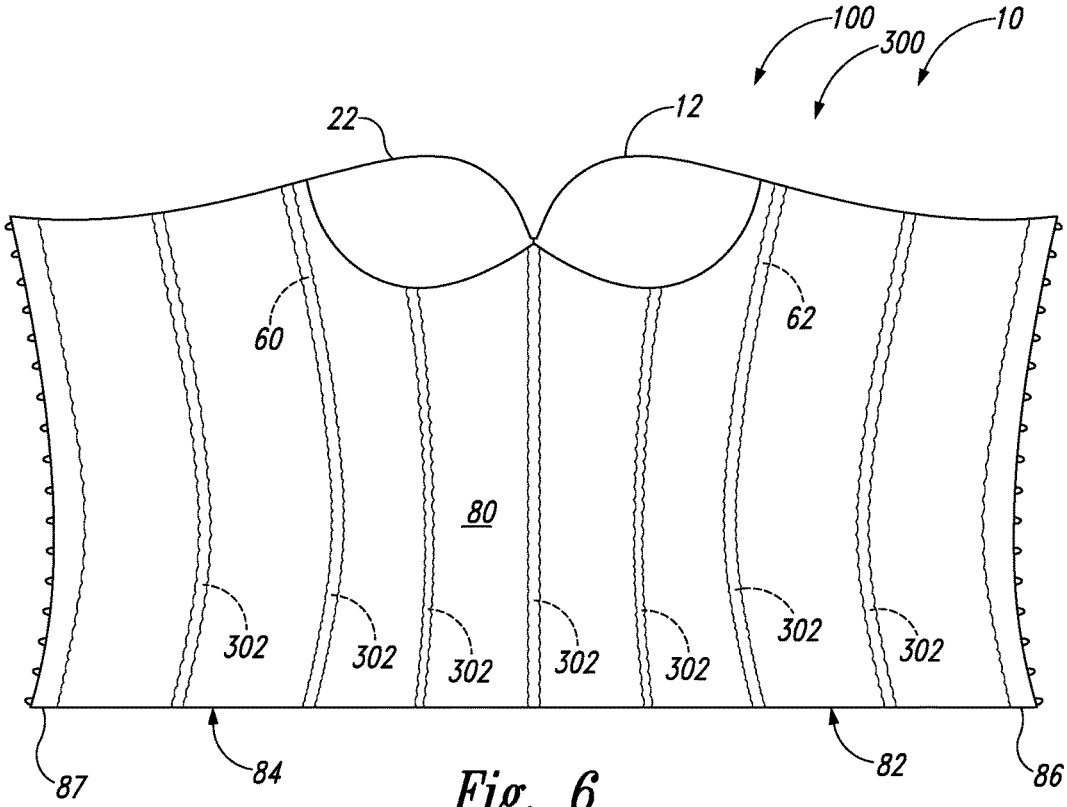
FIG. 6 is a front and open view of an illustrative, non-exclusive example of a breast-supportive garment according to the present disclosure in the form of a corset.
Figure 7:
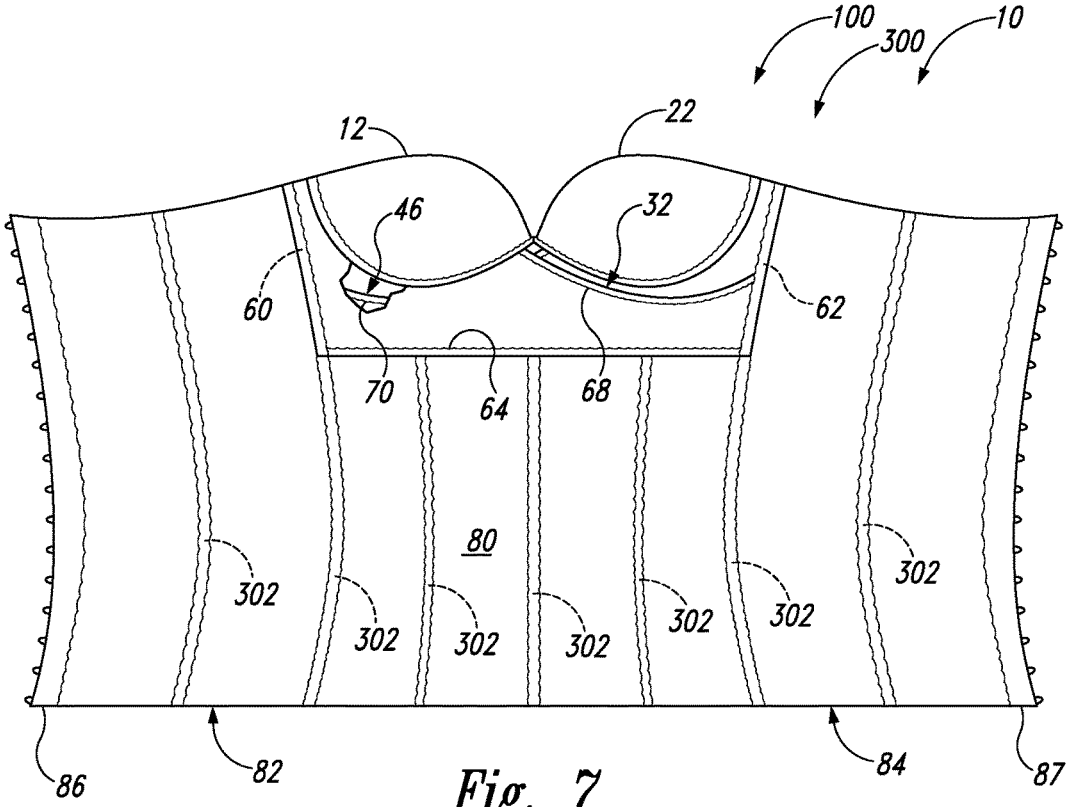
FIG. 7 is a partial fragmentary rear and open view of the corset of FIG. 6.

Turning now to FIGS. 3-7, illustrative non-exclusive examples of breast-supportive garments 10 are illustrated in the form of a bra 200 (FIGS. 3-5) and a corset 300 (FIGS. 6-7). Where appropriate, the reference numerals from the schematic representation of FIG. 1 are used to designate corresponding parts of bra 200 and corset 300; however, the examples of FIGS. 3-7 are non-exclusive and do not limit breast-supportive garments 10 to the illustrated embodiments of bra 200 and corset 300. That is, breast-supportive garments 10 are not limited to the specific embodiments of the illustrated bra 200 and corset 300, and breast-supportive garments 10, as well as articles of clothing 100, may incorporate any number of the various aspects, configurations, characteristics, properties, etc. of breast-supportive garments 10 that are illustrated in and discussed with reference to the schematic representation of FIG. 1 and/or the embodiments of FIGS. 3-7, as well as variations thereof, without requiring the inclusion of all such aspects, configurations, characteristics, properties, etc. For the purpose of brevity, each previously discussed component, part, portion, aspect, region, etc. or variants thereof may not be discussed, illustrated, and/or labeled again with respect to bra 200 and corset 300; however, it is within the scope of the present disclosure that the previously discussed features, variants, etc. may be utilized with bra 200 and corset 300.

Figure 3:
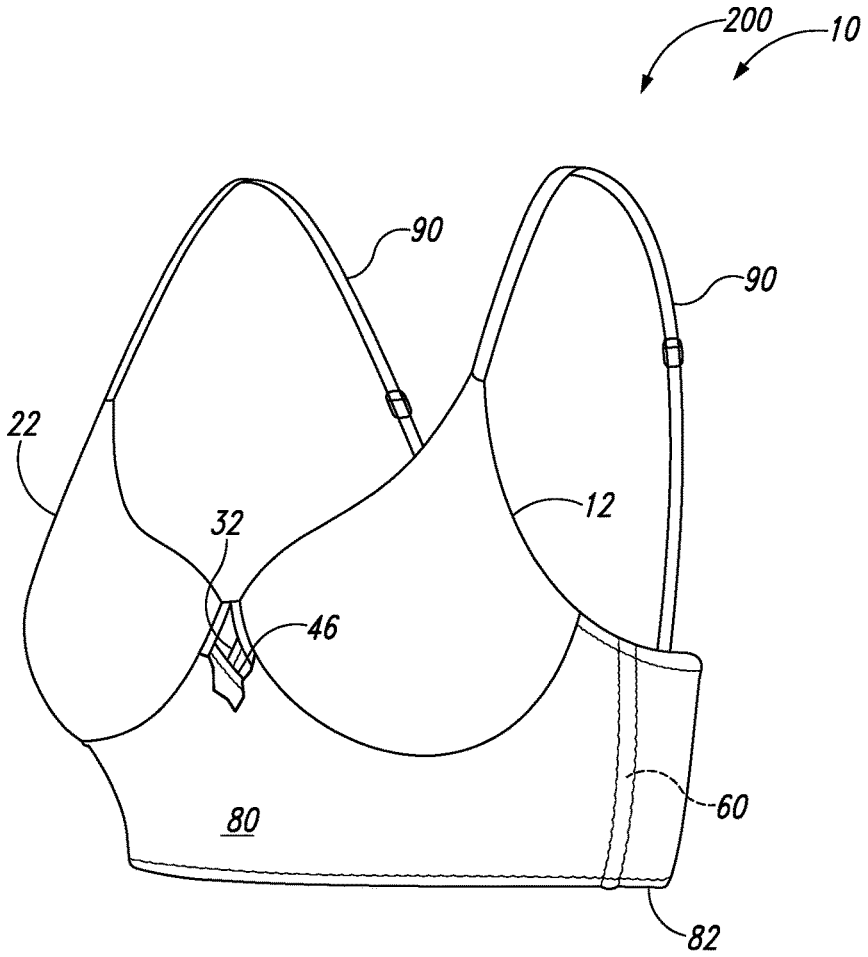
FIG. 3 is a partial fragmentary perspective view of an illustrative, non-exclusive example of a breast-supportive garment according to the present disclosure in the form of a bra.

With reference to FIGS. 3-5, bra 200 is an example of a breast-supportive garment 10 that includes shoulder straps 90, left and right panels 82, 84 with left and right fastening mechanisms 86, 87, and a front panel 80. Moreover, as perhaps best seen in FIG. 5, the second supportive panel 46 extends in front of (or anterior to) the first supportive panel 32. In addition, bra 200 includes left and right boning structures 60, 62 extending along the left and right edges of the supportive panels. Bra 200 also includes a lower-edge elastic band 64 that extends along the lower edges of the first and second supportive panels and the left and right panels, respectively, together with an elastic band 72 that extends along the left-side span of the upper edge of the first supportive panel 32 and the upper edge of the left panel 82 and an elastic band 76 that extends along the right-side span of the upper edge of the second supportive panel 46 and the upper edge of the right panel 84. Also, bra 200 includes an elastic band 68 that extends along the right-side span of the upper edge of the first supportive panel 32, and an elastic band 70 that extends along the left-side span of the upper edge of the second supportive panel 46.

Turning now to FIGS. 6-7, corset 300 may be described as an example of a breast-supportive garment 10 or as an example of an article of clothing 100 that integrates a breast-supportive garment 10 into the corset 300. As best seen in FIG. 7, the second supportive panel 46 extends in front of (or anterior to) the first supportive panel 32. In addition, corset 300 includes a front panel 80 that not only extends in front of (or anterior to) the supportive panels, but also extends downward (or inferior) from the supportive panels to cover a wearer's lower torso. Corset 300 also includes left and right panels 82, 84 with left and right fastening mechanisms 86, 87. Moreover, the left and right panels 82, 84 extend downward (or inferior) together with the front panel 80 to cover the wearer's torso. Also, not only does corset 300 include left and right boning structures 60, 62, but it also includes a plurality of boning ribs 302 spaced-apart around the corset 300. The left and right boning structures 60, 62 may be integral with, or a sub-portion of, two of the boning ribs 302, or the left and right boning structures 60, 62 may be distinct from the boning ribs 302. Corset 300 also includes an elastic band 64 that extends along the lower edges of the first and second supportive panels, an elastic band 68 that extends along the right-side span of the upper edge of the first supportive panel 32, and an elastic band 70 that extends along the left-side span of the upper edge of the second supportive panel 46. Corset 300 does not include shoulder straps; however, breast-supportive garments 10 or articles of clothing 100 may take the form of a corset with shoulder straps.

Illustrative, non-exclusive examples of inventive subject matter according to the present disclosure are described in the following enumerated paragraphs:

A. A breast-supportive garment, comprising:

a left cup structure;

a right cup structure operatively coupled to the left cup structure;

a first supportive panel that extends from left of the left cup structure to right of the right cup structure, extending at least partially below the left cup structure and at least partially below the right cup structure; and a second supportive panel that extends from right of the right cup structure to left of the left cup structure, extending at least partially below the right cup structure and at least partially below the left cup structure;

wherein one of the first supportive panel and the second supportive panel extends substantially in front of the other of the first supportive panel and the second supportive panel.

A1. The breast-supportive garment of paragraph A, wherein a left-side span of an upper edge of the first supportive panel is secured to a substantial length of a lower edge of the left cup structure.

A2. The breast-supportive garment of any of paragraphs A-A1, wherein a right-side span of an/the upper edge of the first supportive panel is not secured to a lower edge of the right cup structure and is not secured to the second supportive panel.

A3. The breast-supportive garment of any of paragraphs A-A2, wherein an upper-most point of a left edge of the first supportive panel is positioned left of a left-most point of the left cup structure.

A4. The breast-supportive garment of any of paragraphs A-A3, wherein an upper-most point of a right edge of the first supportive panel is positioned above a lower-most point of the right cup structure.

A5. The breast-supportive garment of any of paragraphs A-A4, wherein a/the right-side span of an/the upper edge of the first supportive panel extending from a/the lower edge of the left cup structure to an/the upper-most point of a/the right edge of the first supportive panel is concave.

A6. The breast-supportive garment of any of paragraphs A-A5, wherein a right-side span of an upper edge of the second supportive panel is secured to a substantial length of a lower edge of the right cup structure.

A7. The breast-supportive garment of any of paragraphs A-A6, wherein a left-side span of an/the upper edge of the second supportive panel is not secured to a lower edge of the left cup structure and is not secured to the first supportive panel.

A8. The breast-supportive garment of any of paragraphs A-A7, wherein an upper-most point of a right edge of the second supportive panel is positioned right of a right-most point of the right cup structure.

A9. The breast-supportive garment of any of paragraphs A-A8, wherein an upper-most point of a left edge of the second supportive panel is positioned above a lower-most point of the left cup structure.

A10. The breast-supportive garment of any of paragraphs A-A9, wherein a/the left-side span of an/the upper edge of the second supportive panel extending from a/the lower edge of the right cup structure to an/the upper-most point of a/the left edge of the second supportive panel is concave.

A11. The breast-supportive garment of any of paragraphs A-A10, wherein a/the left edge of the first supportive panel coincides with and is secured to a/the left edge of the second supportive panel.

A12. The breast-supportive garment of any of paragraphs A-A11, wherein an/the upper-most point of a/the left edge of the first supportive panel is above an/the upper-most point of a/the left edge of the second supportive panel.

A13. The breast-supportive garment of any of paragraphs A-A12, wherein a/the right edge of the first supportive panel coincides with and is secured to a/the right edge of the second supportive panel.

A14. The breast-supportive garment of any of paragraphs A-A13, wherein an/the upper-most point of a/the right edge of the second supportive panel is above an/the upper-most point of a/the right edge of the first supportive panel.

A15. The breast-supportive garment of any of paragraphs A-A14, wherein a lower edge of the first supportive panel coincides with and is secured to a lower edge of the second supportive panel.

A16. The breast-supportive garment of any of paragraphs A-A15, further comprising:

a left boning structure operatively coupled to one or both of the first supportive panel and the second supportive panel and generally coinciding with one or both of a/the left edge of the first supportive panel and a/the left edge of the second supportive panel.

A16.1. The breast-supportive garment of paragraph A16, wherein the left boning structure is generally coextensive with the left edge of the first supportive panel.

A17. The breast-supportive garment of any of paragraphs A-A16.1, further comprising:

a right boning structure operatively coupled to one or both of the first supportive panel and the second supportive panel and generally coinciding with one or both of a/the right edge of the second supportive panel and a/the right edge of the first supportive panel.

A17.1. The breast-supportive garment of paragraph A17, wherein the right boning structure is generally coextensive with the right edge of the second supportive panel.

A18. The breast-supportive garment of any of paragraphs A-A17.1, further comprising:

a lower-edge elastic band extending along a/the lower edge of the first supportive panel and a/the lower edge of the second supportive panel.

A18.1. The breast-supportive garment of paragraph A18, wherein the lower-edge elastic band has a relaxed length when a tensile force is not applied to the lower-edge elastic band, and wherein the relaxed length is less than a distance between an/the upper-most point of a/the left edge of the first supportive panel and an/the upper-most point of a/the right edge of the second supportive panel.

A18.2. The breast-supportive garment of any of paragraphs A18-A18.1, wherein the lower-edge elastic band has a/the relaxed length when a/the tensile force is not applied to the lower-edge elastic band, and wherein the relaxed length is less than a distance between a/the left-most point of the left cup structure and a/the right-most point of the right cup structure.

A19. The breast-supportive garment of any of paragraphs A-A18.2, further comprising:

a first-supportive-panel right-side upper-edge elastic band extending along a/the right-side span of an/the upper edge of the first supportive panel; and a second-supportive-panel left-side upper-edge elastic band extending along a/the left-side span of an/the upper edge of the second supportive panel.

A20. The breast-supportive garment of any of paragraphs A-A19, further comprising:

a first-supportive-panel left-side upper-edge elastic band extending along a left-side span of an/the upper edge of the first supportive panel between a/the left-most point of the left cup structure and an/the upper-most point of a/the left edge of the first supportive panel; and a second-supportive-panel right-side upper-edge elastic band extending along a right-side span of an/the upper edge of the second supportive panel between a/the right-most point of the right cup structure and an/the upper-most point of a/the right edge of the second supportive panel.

A21. The breast-supportive garment of any of paragraphs A-A20, wherein the first supportive panel and the second supportive panel are constructed of an elastic material, wherein a/the lower edge of the first supportive panel and a/the lower edge of the second supportive panel have a/the relaxed length when a lateral tensile force is not applied to the first supportive panel and the second supportive panel, and wherein the relaxed length is less than a distance between an/the upper-most point of a/the left edge of the first supportive panel and an/the upper-most point of a/the right edge of the second supportive panel.

A21.1. The breast-supportive garment of paragraph A21, wherein the relaxed length is less than a distance between a/the left-most point of the left cup structure and a/the right-most point of the right cup structure.

A22. The breast-supportive garment of any of paragraphs A-A21.1, further comprising:

a front panel extending in front of and covering the first supportive panel and the second supportive panel.

A22.1. The breast-supportive garment of paragraph A22, wherein the front panel is secured along a/the lower edge of the left cup structure, along a/the lower edge of the right cup structure, along a/the lower edge of the first supportive panel, along a/the lower edge of the second supportive panel, along a/the left edge of the first supportive panel, along a/the left edge of the second supportive panel, along a/the right edge of the first supportive panel, and along a/the right edge of the second supportive panel.

A22.2. The breast-supportive garment of any of paragraphs A22-A22.1, wherein the front panel is constructed from a material that is different from a material of one or both of the first supportive panel and the second supportive panel.

A23. The breast-supportive garment of any of paragraphs A-A22.2, further comprising:

a left panel that extends left of the first supportive panel and the second supportive panel;

a left fastening mechanism coupled to the left panel;

a right panel that extends right of the first supportive panel and the second supportive panel; and a right fastening mechanism coupled to the right panel and configured to be selectively coupled to the left fastening mechanism behind a wearer's back when the breast-supportive garment is donned.

A23.1. The breast-supportive garment of paragraph A23 when depending from paragraph A18, wherein the lower-edge elastic band further extends along a lower edge of the left panel and along a lower edge of the right panel.

A23.2. The breast-supportive garment of any of paragraphs A23-A23.1 when depending from paragraph A20, wherein the first-supportive-panel left-side upper-edge elastic band further extends along an upper edge of the left panel; and wherein the second-supportive-panel right-side upper-edge elastic band further extends along an upper edge of the right panel.

A23.3. The breast-supportive garment of any of paragraphs A23-A23.2, wherein the left panel and the right panel are constructed of an/the elastic material.

A24. The breast-supportive garment of any of paragraphs A-A22.3, further comprising:

a back panel that extends left of the first supportive panel and the second supportive panel and that extends right of the first supportive panel and the second supportive panel to create a closed loop with the first supportive panel and the second supportive panel for selective receipt of a wearer's upper torso when the breast-supportive garment is donned.

A24.1. The breast-supportive garment of paragraph A24, wherein the back panel is free of a fastening mechanism.

A24.2. The breast-supportive garment of any of paragraphs A24-A24.1 when depending from paragraph A18, wherein the lower-edge elastic band further extends along a lower edge of the back panel.

A24.3. The breast-supportive garment of any of paragraphs A24-A24.2 when depending from paragraph A20, wherein the first-supportive-panel left-side upper-edge elastic band and the second-supportive-panel right-side upper-edge elastic band are the same elastic band that further extends along an upper edge of the back panel.

A24.4. The breast-supportive garment of any of paragraphs A24-A24.3, wherein the back panel is constructed of an/the elastic material.

A25. The breast-supportive garment of any of paragraphs A-A24.4, further comprising:

shoulder straps operatively coupled relative to the left cup structure and the right cup structure and configured to extend over a wearer's shoulders when the breast-supportive garment is donned.

A25.1. The breast-supportive garment of paragraph A25 when depending from paragraph A23, wherein the shoulder straps are further operatively coupled to the left panel and the right panel.

A25.2. The breast-supportive garment of paragraph A25 when depending from paragraph A24, wherein the shoulder straps are further operatively coupled to the back panel.

A26. The breast-supportive garment of any of paragraphs A-A25.2, wherein the breast-supportive garment is free of underwires.

A27. The breast-supportive garment of any of paragraphs A-A26, wherein the left cup structure and the right cup structure are free of push-up pads.

A28. The breast-supportive garment of any of paragraphs A-A27, wherein the left cup structure and the right cup structure are generally uniform in thickness across their entireties.

A29. The breast-supportive garment of any of paragraphs A-A28, wherein the first supportive panel and the second supportive panel collectively bring together and support from beneath a wearer's breasts within the left cup structure and the right cup structure when the breast-supportive garment is donned.

A30. The breast-supportive garment of any of paragraphs A-A29, wherein a/the right-side span of the upper edge of the first supportive panel supports from beneath a wearer's right breast when the breast-supportive garment is donned; and wherein a/the left-side span of the upper edge of the second supportive panel supports from beneath a wearer's left breast when the breast-supportive garment is donned.

A30.1. The breast-supportive garment of paragraph A30, wherein the right-side span of the upper edge of the first supportive panel extends below the wearer's right breast when the breast-supportive garment is donned; and wherein the left-side span of the upper edge of the second supportive panel extends below the wearer's left breast when the breast-supportive garment is donned.

A31. The breast-supportive garment of any of paragraphs A-A30.1, wherein a/the lower edge of the left cup structure is positioned in front of a/the wearer's left breast and above a lower extent of the wearer's left breast when the breast-supportive garment is donned; and wherein a/the lower edge of the right cup structure is positioned in front of a/the wearer's right breast and above a lower extent of the wearer's right breast when the breast-supportive garment is donned.

B. A breast-supportive garment, comprising:

a left cup structure having a left-cup arcuate lower edge with a left-cup lower-most point, a left-cup left-most point, and a left-cup right-most point;

a right cup structure having a right-cup arcuate lower edge with a right-cup lower-most point, a right-cup right-most point, and a right-cup left-most point, wherein the right cup structure is operatively coupled to the left cup structure;

a first supportive panel having a first-supportive-panel upper edge with a first-supportive-panel upper-edge left-side span and a first-supportive-panel upper-edge right-side span, a first-supportive-panel left edge with a first-supportive-panel left-edge upper-most point, a first-supportive-panel right edge with a first-supportive-panel right-edge upper-most point, and a first-supportive panel lower edge, wherein the first-supportive-panel upper-edge left-side span is secured to a substantial length of the left-cup arcuate lower edge, wherein the first-supportive-panel upper-edge right-side span is not secured to the right-cup arcuate lower edge, wherein the first-supportive-panel left-edge upper-most point is positioned to the left of the left-cup left-most point, and wherein the first-supportive-panel right-edge upper-most point is positioned above the right-cup lower-most point;

a second supportive panel having a second-supportive-panel upper edge with a second-supportive-panel upper-edge right-side span and a second supportive-panel upper-edge left-side span, a second-supportive-panel right edge with a second-supportive-panel right-edge upper-most point, a second-supportive-panel left edge with a second-supportive-panel left-edge upper-most point, and a second-supportive panel lower edge, wherein the second-supportive-panel upper-edge right-side span is secured to a substantial length of the right-cup arcuate lower edge, wherein the second-supportive-panel upper-edge left-side span is not secured to the left-cup arcuate lower edge and is not secured to the first supportive panel, wherein the second-supportive-panel right-edge upper-most point is positioned to the right of the right-cup right-most point, wherein the second-supportive-panel left-edge upper-most point is positioned above the left-cup lower-most point, wherein one of the first supportive panel and the second supportive panel extends substantially in front of the other of the first supportive panel and the second supportive panel;

a left boning structure operatively coupled to one or both of the first supportive panel and the second supportive panel and generally coinciding with the first-supportive-panel left edge and the second-supportive-panel left edge; and a right boning structure operatively coupled to one or both of the first supportive panel and the second supportive panel and generally coinciding with the first-supportive-panel right edge and the second-supportive-panel right edge.

B1. The breast-supportive garment of paragraph B, further comprising:

a lower-edge elastic band extending along the first-supportive-panel lower edge and the second-supportive-panel lower edge, wherein the lower-edge elastic band has a relaxed length when a tensile force is not applied to the lower-edge elastic band, and wherein the relaxed length is less than a distance between the first-supportive-panel left-edge upper-most point and the second-supportive-panel right-edge upper-most point;

a first-supportive-panel right-side upper-edge elastic band extending along the first-supportive-panel upper-edge right-side span; and a second-supportive-panel left-side upper-edge elastic band extending along the second-supportive-panel upper-edge left-side span.

B2. The breast-supportive garment of any of paragraphs B-B1, further comprising the subject matter of any of paragraphs A-A31.

C. An article of clothing, comprising:

the breast-supportive garment of any of paragraphs A-B2 integrated into the article of clothing.

C1. The article of clothing of paragraph C, wherein the article of clothing is a bra, a bra top, a corset, swimwear, a swim top, a single-piece swim top, a one-piece swimsuit, a top, a crop top, a blouse, a shirt, a camisole, a sports bra, a sports top, an athletic top, or a dress.

D. A method of donning the breast-supportive garment of any of paragraphs A-B2 or the article of clothing of any of paragraphs C-C1, comprising:

positioning the left cup structure against a wearer's left breast; and positioning the right cup structure against a wearer's right breast.

D1. The method of paragraph D, wherein the positioning the left cup structure comprises positioning a/the lower edge of the left cup structure in front of and above a/the lower extent of the wearer's left breast; and wherein the positioning the right cup structure comprises positioning a/the lower edge of the right cup structure in front of and above a/the lower extent of the wearer's right breast.

E. The use of the breast-supportive garment of any of paragraphs A-B2 to support breasts and/or enhance cleavage.

F. The use of the article of clothing of any of paragraphs C-C1 to support breasts and/or enhance cleavage.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

The various disclosed elements of apparatuses and steps of methods disclosed herein are not required to all apparatuses and methods according to the present disclosure, and the present disclosure includes all novel and non-obvious combinations and subcombinations of the various elements and steps disclosed herein. Moreover, one or more of the various elements and steps disclosed herein may define independent inventive subject matter that is separate and apart from the whole of a disclosed apparatus or method. Accordingly, such inventive subject matter is not required to be associated with the specific apparatuses and methods that are expressly disclosed herein, and such inventive subject matter may find utility in apparatuses and/or methods that are not expressly disclosed herein.

The invention claimed is:

1. A breast-supportive garment, comprising:

a left cup structure having a left-cup arcuate lower edge with a left-cup lower-most point, a left-cup left-most point, and a left-cup right-most point;

a right cup structure having a right-cup arcuate lower edge with a right-cup lower-most point, a right-cup right-most point, and a right-cup left-most point, wherein the right cup structure is operatively coupled to the left cup structure;

a first supportive panel having a first-supportive-panel upper edge with a first-supportive-panel upper-edge left-side span and a first-supportive-panel upper-edge right-side span, a first-supportive-panel left edge with a first-supportive-panel left-edge upper-most point, a first-supportive-panel right edge with a first-supportive-panel right-edge upper-most point, and a first-supportive panel lower edge, wherein the first-supportive-panel upper-edge left-side span is secured to a substantial length of the left-cup arcuate lower edge, wherein the first-supportive-panel upper-edge right-side span is not secured to the right-cup arcuate lower edge, wherein the first-supportive-panel left-edge upper-most point is positioned to the left of the left-cup left-most point, and wherein the first-supportive-panel right-edge upper-most point is positioned above the right-cup lower-most point;

a second supportive panel having a second-supportive-panel upper edge with a second-supportive-panel upper-edge right-side span and a second supportive-panel upper-edge left-side span, a second-supportive-panel right edge with a second-supportive-panel right-edge upper-most point, a second-supportive-panel left edge with a second-supportive-panel left-edge upper-most point, and a second-supportive panel lower edge, wherein the second-supportive-panel upper-edge right-side span is secured to a substantial length of the right-cup arcuate lower edge, wherein the second-supportive-panel upper-edge left-side span is not secured to the left-cup arcuate lower edge and is not secured to the first supportive panel, wherein the second-supportive-panel right-edge upper-most point is positioned to the right of the right-cup right-most point, wherein the second-supportive-panel left-edge upper-most point is positioned above the left-cup lower-most point, wherein one of the first supportive panel and the second supportive panel extends substantially in front of the other of the first supportive panel and the second supportive panel;

a left boning structure operatively coupled to one or both of the first supportive panel and the second supportive panel and generally coinciding with the first-supportive-panel left edge and the second-supportive-panel left edge; and a right boning structure operatively coupled to one or both of the first supportive panel and the second supportive panel and generally coinciding with the first-supportive-panel right edge and the second-supportive-panel right edge.

2. The breast-supportive garment of claim 1, further comprising:

a lower-edge elastic band extending along the first-supportive-panel lower edge and the second-supportive-panel lower edge, wherein the lower-edge elastic band has a relaxed length when a tensile force is not applied to the lower-edge elastic band, and wherein the relaxed length is less than a distance between the first-supportive-panel left-edge upper-most point and the second-supportive-panel right-edge upper-most point;

a first-supportive-panel right-side upper-edge elastic band extending along the first-supportive-panel upper-edge right-side span; and a second-supportive-panel left-side upper-edge elastic band extending along the second-supportive-panel upper-edge left-side span.

3. A breast-supportive garment, comprising:

a left cup structure;

a right cup structure operatively coupled to the left cup structure;

a first supportive panel that extends from left of the left cup structure to right of the right cup structure, extending at least partially below the left cup structure and at least partially below the right cup structure; and a second supportive panel that extends from right of the right cup structure to left of the left cup structure, extending at least partially below the right cup structure and at least partially below the left cup structure;

wherein one of the first supportive panel and the second supportive panel extends substantially in front of the other of the first supportive panel and the second supportive panel;

wherein a left-side span of an upper edge of the first supportive panel is secured to a substantial length of a lower edge of the left cup structure;

wherein a right-side span of the upper edge of the first supportive panel is not secured to a lower edge of the right cup structure and is not secured to the second supportive panel;

wherein a right-side span of an upper edge of the second supportive panel is secured to a substantial length of a lower edge of the right cup structure; and wherein a left-side span of the upper edge of the second supportive panel is not secured to the lower edge of the left cup structure and is not secured to the first supportive panel.

4. The breast-supportive garment of claim 3, wherein an upper-most point of a left edge of the first supportive panel is positioned left of a left-most point of the left cup structure;

wherein an upper-most point of a right edge of the first supportive panel is positioned above a lower-most point of the right cup structure;

wherein an upper-most point of a right edge of the second supportive panel is positioned right of a right-most point of the right cup structure; and wherein an upper-most point of a left edge of the second supportive panel is positioned above a lower-most point of the left cup structure.

5. The breast-supportive garment of claim 3, wherein the right-side span of the upper edge of the first supportive panel extends from the lower edge of the left cup structure to an upper-most point of a right edge of the first supportive panel and is concave; and wherein the left-side span of the upper edge of the second supportive panel extends from the lower edge of the right cup structure to an upper-most point of a left edge of the second supportive panel and is concave.

6. The breast-supportive garment of claim 3, wherein a left edge of the first supportive panel coincides with and is secured to a left edge of the second supportive panel; and wherein a right edge of the first supportive panel coincides with and is secured to a right edge of the second supportive panel.

7. The breast-supportive garment of claim 6, wherein an upper-most point of the left edge of the first supportive panel is above an upper-most point of the left edge of the second supportive panel; and wherein an upper-most point of the right edge of the second supportive panel is above an upper-most point of the right edge of the first supportive panel.

8. The breast-supportive garment of claim 3, wherein a lower edge of the first supportive panel coincides with and is secured to a lower edge of the second supportive panel.

9. The breast-supportive garment of claim 3, further comprising:

a left boning structure operatively coupled to one or both of the first supportive panel and the second supportive panel and generally coinciding with one or both of a left edge of the first supportive panel and a left edge of the second supportive panel; and a right boning structure operatively coupled to one or both of the first supportive panel and the second supportive panel and generally coinciding with one or both of a right edge of the second supportive panel and a right edge of the first supportive panel.

10. The breast-supportive garment of claim 9, wherein the left boning structure is generally coextensive with the left edge of the first supportive panel; and wherein the right boning structure is generally coextensive with the right edge of the second supportive panel.

11. The breast-supportive garment of claim 3, wherein a lower edge of the first supportive panel coincides with and is secured to a lower edge of the second supportive panel; and wherein the breast-supportive garment further comprises a lower-edge elastic band extending along the lower edge of the first supportive panel and the lower edge of the second supportive panel.

12. The breast-supportive garment of claim 11, wherein the lower-edge elastic band has a relaxed length when a tensile force is not applied to the lower-edge elastic band, and wherein the relaxed length is less than a distance between an upper-most point of a left edge of the first supportive panel and an upper-most point of a right edge of the second supportive panel.

13. The breast-supportive garment of claim 3, further comprising:

a first-supportive-panel right-side upper-edge elastic band extending along the right-side span of the upper edge of the first supportive panel; and a second-supportive-panel left-side upper-edge elastic band extending along the left-side span of the upper edge of the second supportive panel.

14. The breast-supportive garment of claim 3, wherein the first supportive panel and the second supportive panel are constructed of an elastic material, wherein a lower edge of the first supportive panel and a lower edge of the second supportive panel have a relaxed length when a lateral tensile force is not applied to the first supportive panel and the second supportive panel, and wherein the relaxed length is less than a distance between an upper-most point of a left edge of the first supportive panel and an upper-most point of a right edge of the second supportive panel.

15. The breast-supportive garment of claim 3, further comprising:

a front panel extending in front of and covering the first supportive panel and the second supportive panel.

16. The breast-supportive garment of claim 3, further comprising:

a left panel that extends left of the first supportive panel and the second supportive panel;

a left fastening mechanism coupled to the left panel;

a right panel that extends right of the first supportive panel and the second supportive panel; and a right fastening mechanism coupled to the right panel and configured to be selectively coupled to the left fastening mechanism behind a wearer's back when the breast-supportive garment is donned.

17. The breast-supportive garment of claim 3, further comprising:

a back panel that extends left of the first supportive panel and the second supportive panel and that extends right of the first supportive panel and the second supportive panel to create a closed loop with the first supportive panel and the second supportive panel for selective receipt of a wearer's upper torso when the breast-supportive garment is donned.

18. The breast-supportive garment of claim 3, further comprising:

shoulder straps operatively coupled relative to the left cup structure and the right cup structure and configured to extend over a wearer's shoulders when the breast-supportive garment is donned.

19. The breast-supportive garment of claim 3, wherein the breast-supportive garment is free of underwires.

20. A method of donning the breast-supportive garment of claim 3, comprising:

positioning the lower edge of the left cup structure in front of and above a lower extent of a wearer's left breast; and positioning the lower edge of the right cup structure in front of and above a lower extent of a wearer's right breast.

* * * * *